US007475756B2

(12) United States Patent
Maury et al.

(10) Patent No.: US 7,475,756 B2
(45) Date of Patent: Jan. 13, 2009

(54) MECHANISM FOR INDENTING A SAFETY GEAR FOR AN ELEVATOR CAR

(75) Inventors: Julien Maury, Lucerne (CH); Stefan Hugel, Adligenswil (CH)

(73) Assignee: Inventio AG, Hergiswil NW (CH)

( * ) Notice: Subject to any disclaimer, the term of this patent is extended or adjusted under 35 U.S.C. 154(b) by 973 days.

(21) Appl. No.: 10/405,518

(22) Filed: Apr. 2, 2003

(65) Prior Publication Data

US 2003/0183457 A1 Oct. 2, 2003

(30) Foreign Application Priority Data

Apr. 2, 2002 (EP) ..... 02405252

(51) Int. Cl.
*B66B 5/04* (2006.01)
*B66B 5/12* (2006.01)

(52) U.S. Cl. ..... 187/373; 187/361

(58) Field of Classification Search ..... 187/250, 187/350, 351, 373–375, 366, 376
See application file for complete search history.

(56) References Cited

U.S. PATENT DOCUMENTS 1,678,031 A * 7/1928 Anderson ..... 187/376
1,937,035 A * 11/1933 Dunlop ..... 187/376
2,274,000 A * 2/1942 Sahlin ..... 187/376
3,441,107 A * 4/1969 Dingfeld et al. ..... 187/376
4,083,432 A * 4/1978 Lusti ..... 187/373
4,565,264 A * 1/1986 Kunii ..... 187/373
5,495,919 A 3/1996 Ericson et al.
6,619,435 B1 * 9/2003 Watzke et al. ..... 187/373

FOREIGN PATENT DOCUMENTS

| | | |
|---|---|---|
| EP | 0 980 842 A1 | 2/2000 |
| GB | 2.179795 A | 3/1987 |
| JP | 2144389 | 6/1990 |
| JP | 2000-219450 A | 8/2000 |

* cited by examiner

*Primary Examiner*—Peter M Cuomo
*Assistant Examiner*—Eric Pico
(74) *Attorney, Agent, or Firm*—Schweitzer Cornman Gross & Bondell LLP

(57) ABSTRACT

In relation with this mechanism for stopping an elevator car is, for the monitoring of the speed of the elevator car, an overspeed governor provided which works based on the swing lever principle, whereby the movement of the elevator car will be transferred by means of a governor rope to the overspeed governor. The governor rope extends itself over the entire shaft height and will be returned at the lower shaft end by means of a deflection sheave and stretched by means of counterweight as well as guided at the upper shaft end over a pulley of the overspeed governor. The ends of the governor rope are fastened on a release mechanics arranged on the elevator car and such release mechanics operates in an emergency a safety gear arranged on the elevator car. With the overspeed of the elevator car a rope brake is released upwards.

5 Claims, 4 Drawing Sheets

MECHANISM FOR INDENTING A SAFETY GEAR FOR AN ELEVATOR CAR

The invention concerns a mechanism for activating or indenting a safety gear for an elevator car or for a counterweight consisting of an overspeed governor supervising the speed of an elevator car, which is connected by means of hoist rope with the counterweight, whereby the motion of the elevator car or respectively of the counterweight is transferable to the overspeed governor by means of a governor rope and said overspeed governor triggers the stopping of the elevator installation in case of overspeed.

BACKGROUND OF THE INVENTION

An overspeed governor supervising the driving speed of an elevator car is known from patent document DE 36 15 270 C2 (also GB 2,179,795A). The elevator car moves a pulley with an integrated locking rim over a wire rope. A valve timing gear displaces a swing catch with a swing lever in oscillating motions. An operating lever is fixed on the swing lever in a rotational manner, and the operating lever is held in a rest position opposite the swing lever by means of a retaining mechanism. The upper end of the operating lever is formed as an operating bow, at the lower end is located the releasing catch, protuberant opposite a swing catch. Both catches are placed between two locking rim teeth whenever the swivel-join roller stands on a cam. When the swivel-join roller stands between two cams, both catches are raised from the track of the locking rim teeth. In that way, the locking rim teeth passes without acting on the catches. In case of overspeed, the swivel-join roller raises from the valve timing gear. The release catch remains immersed in the locking rim track. A locking rim tooth acts on the release catch and drives out the operating lever. In that way, the operating bow switches off the gear via a switch. With further rise of the car speed, the swing catch dips into the locking rim track and blocks the pulley over the locking rim teeth. The force for the re-lease of a safety gear is developed through the friction in the rope groove.

A disadvantage of such a known mechanism lies in the fact that the stopping of the elevator car can also take place if no necessity exists.

BRIEF DESCRIPTIONS OF THE INVENTION

The present invention avoids the deficiencies of the prior art, and embodies a mechanism to be utilized in connection with an overspeed governor that monitors and supervises the speed of an elevator car and/or counterweight which are connected together by a hoist rope. A governor rope transfers speed or motion of the car/counterweight to the overspeed governor, which triggers a stopping of the car through braking of a governor rope which in turn actuates a car safety gear. The mechanism includes a release mechanism which is operable by the governor rope, the release mechanism including a locking element which retains the release mechanism in an unreleased, unlocked condition and which requires an increased force by the governor rope to be applied to permit release or actuation of the release mechanism, which in turn actuates a release of the safety gear to stop the elevator car. An auxiliary rope brake for the governor rope may be included to provide the needed additional governor rope force to activate the release mechanism.

The advantages obtained by the invention are to be seen essentially in the fact that during a travel on the hoistway pit buffer or during test travels, the force of inertia of the governor rope does not release the safety gear unnecessarily. This is of benefit, since a subsequent release of the elevator car or of the counterweight from an activated safety gear requires substantial effort. In addition, the wedges of the safety gear can damage the safety rails. With the mechanism conforming to the invention, the stopping of the elevator car in considerable hoisting heights is ensured in an emergency, while lessening the likelihood of unwanted engagement.

BRIEF DESCRIPTION OF THE DRAWINGS

The invention will be described in more detail in the following description of a preferred, but nonetheless illustrative embodiment with the help of the attached Figures, wherein.

DETAILED DESCRIPTION OF THE INVENTION

Figure 1:
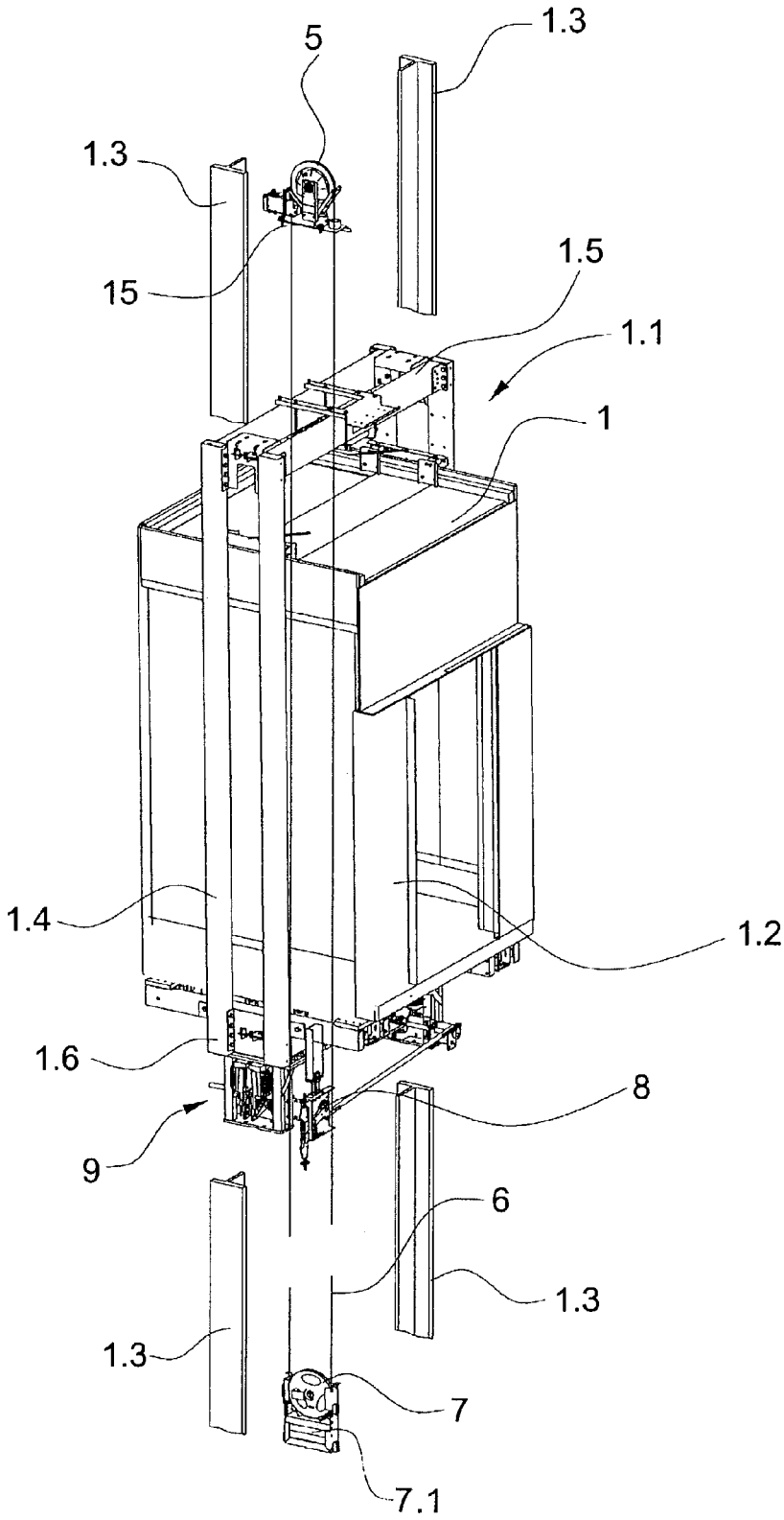
FIG. 1 is a perspective view of an elevator installation with a mechanism for stopping the elevator installation in accordance with the invention.

In FIG. 1 an elevator car travelling in an elevator shaft 1.1 is marked with 1, and such elevator car is connected with a counterweight by means of a hoist rope guided over a driving disk or pulley. The driving disk, hoist rope and counterweight are not shown. A car door 1.2 locks the elevator car 1. Safety rails 1.3 lead the elevator car 1 along the ways. For monitoring the speed of the elevator car 1, either directly or through the counterweight, an overspeed governor 5 operating on the swing lever principle, for example, may be provided, whereby the movement of the elevator car 1 (or the counterweight) is transferred to the overspeed governor 5 by means of a governor rope 6. Governors working on the centrifugal force principle or on the mass inertia principle can also be used for such speed monitoring. The governor rope 6 extends over the entire shaft height and it is looped at the lower shaft end by means of a deflection sheave 7 and maintained in tension by means of a counterweight 7.1. The governor rope is led at the upper shaft end over a pulley 17 of the overspeed governor 5. The ends of the governor rope 6 are fastened at a release mechanism 8, which is arranged at the elevator car 1, and which in an emergency operates a safety gear 9, which is also arranged on the elevator car 1. With overspeed of the elevator car 1 in the downward direction, a rope brake 15 is released by means of an actuating mechanism 14.

Figure 2:
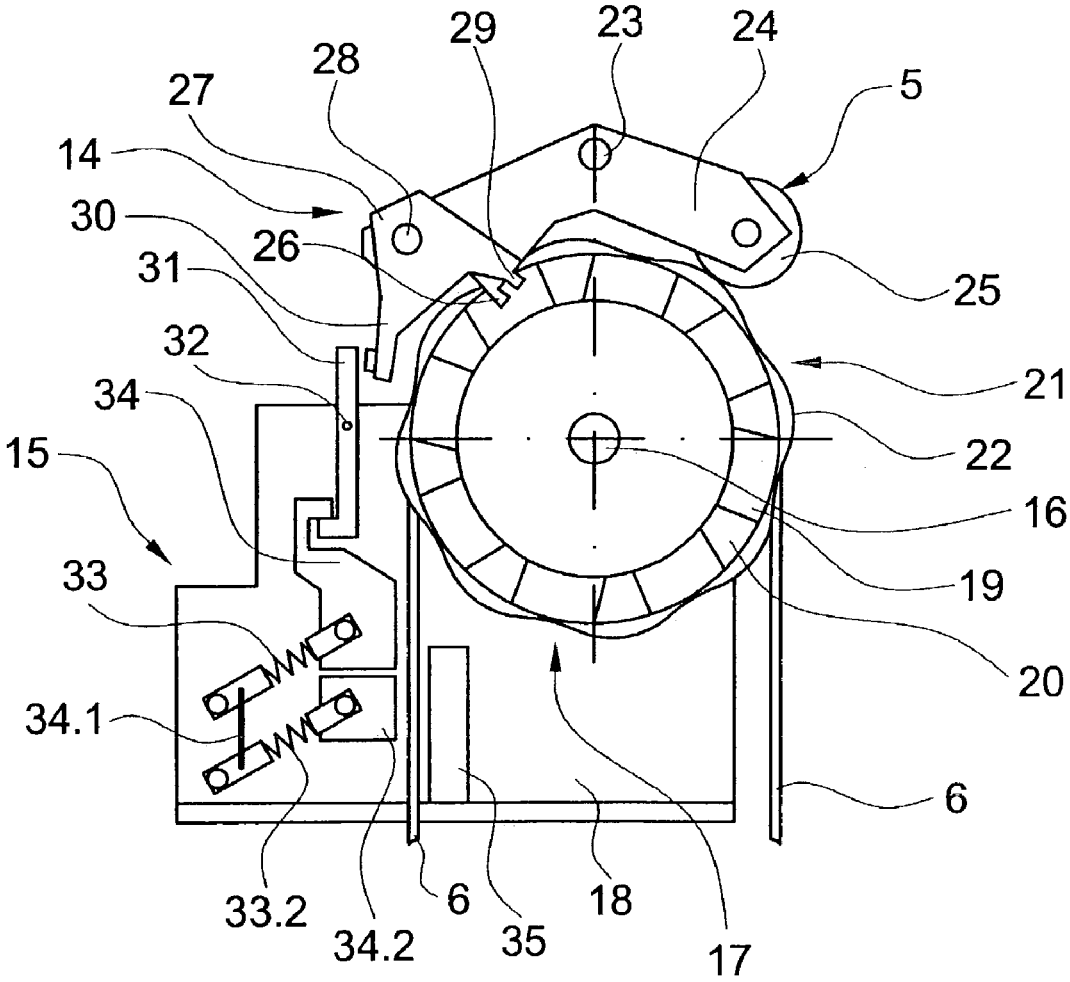
FIG. 2 is a schematic view of an overspeed governor of the invention for operating a rope brake acting on a governor rope.

FIG. 2 shows details of the overspeed governor 5, the actuating mechanism 14 and the rope brake 15. The governor rope 6 is directed to a rope groove in a pulley 17, which is rotates on a first axle 16. The first axle 16 is carried by a housing 18. The pulley has a locking rim 19 with locking rim teeth 20 and a valve timing gear 21 with cams 22. The housing 18 also carries a second axle 23, on which a swing lever 24 with a swivel-join roller 25 are fixed in a rotational manner. When the elevator is operating at a normal speed, the swivel-join roller 25 follows the cam track of the valve timing gear 21 along the cams 22. With the elevator operating at an overspeed, the swivel-join roller 25 is no longer able to follow the contour of cam track due to the inertia of the swing lever 24.

At an end of the swing lever 24, lying opposite the swivel-join roller 25, is an operating lever 27 arranged in a rotational manner on a third axle 28 of the swing lever 24. The operating lever 27 is held in a rest position by means of a retaining mechanism, for example by means of a catcher relative to the swing lever 24. When the elevator is operating at normal speed, a second catch 29 of the operating lever 27 dips between two adjacent locking rim teeth 20 when the swivel-join roller 25 stands on a cam 22, as seen in FIG. 2, and is raised above the track of the locking rim teeth 20 when the swivel-join roller 25 stands in a depression between two cams 22. With overspeed of the elevator car 1 in the downward direction, (represented by counterclockwise rotation of the pulley 17 in FIG. 2) the second catch 29 cannot rise up, since swivel-join roller 25 no longer follows the cams 22, and remains between two locking rim teeth 20, whereby the left flank of the second or following locking rim tooth 20 contacts the second catch 29, and shifting the operating lever 27 in a clockwise rotation. As the locking rim 19 and thus the pulley 17 and the governor rope 6 move on, the clockwise rotation of the operating lever 27 causes operating leg 30 of the operating lever 27 to shift a second release lever 31 of the rope brake 15 in a counter-clockwise manner around a fourth axle 32 of the rope brake 15, whereby a brake block 34 is released. The brake block 34 moves downwards and, by means of a compression spring 33, is pressed against at least a counter-block 35 arranged on the housing 18, whereby the running governor rope 6 is braked between the blocks 34, 35. In FIG. 2, an auxiliary rope brake with an auxiliary block 34.2 and with a compression spring 33.2 are provided, which are connected with the compression spring 33 by means of a bar 34.1 in an articulated manner. Depending upon hoisting height, further auxiliary blocks, compression springs and bars can also be provided.

At the end of the swing lever 24, laying opposite the swivel-join roller 25, a first catch 26 is arranged, which with normal velocity of the elevator car 1 dips between two locking rim teeth 20, when the swivel-join roller 25 stands on a cam 22 and is raised from the track of the locking rim teeth 20 when the swivel-join roller 25 stands between two cams 22. With overspeed of the elevator car 1 in the downward direction, the first catch 26 stops between two locking rim teeth 20, whereby the left flank of the following locking rim tooth 20 appears on the first catch 26 and blocks the locking rim 19 and thus the pulley 17.

By the relative motion of the elevator car 1 with respect to the governor rope 6 the safety gear 9 is activated by means of the release mechanism 8 and the elevator car 1 is engaged with the safety rails 1.3.

Figure 3:
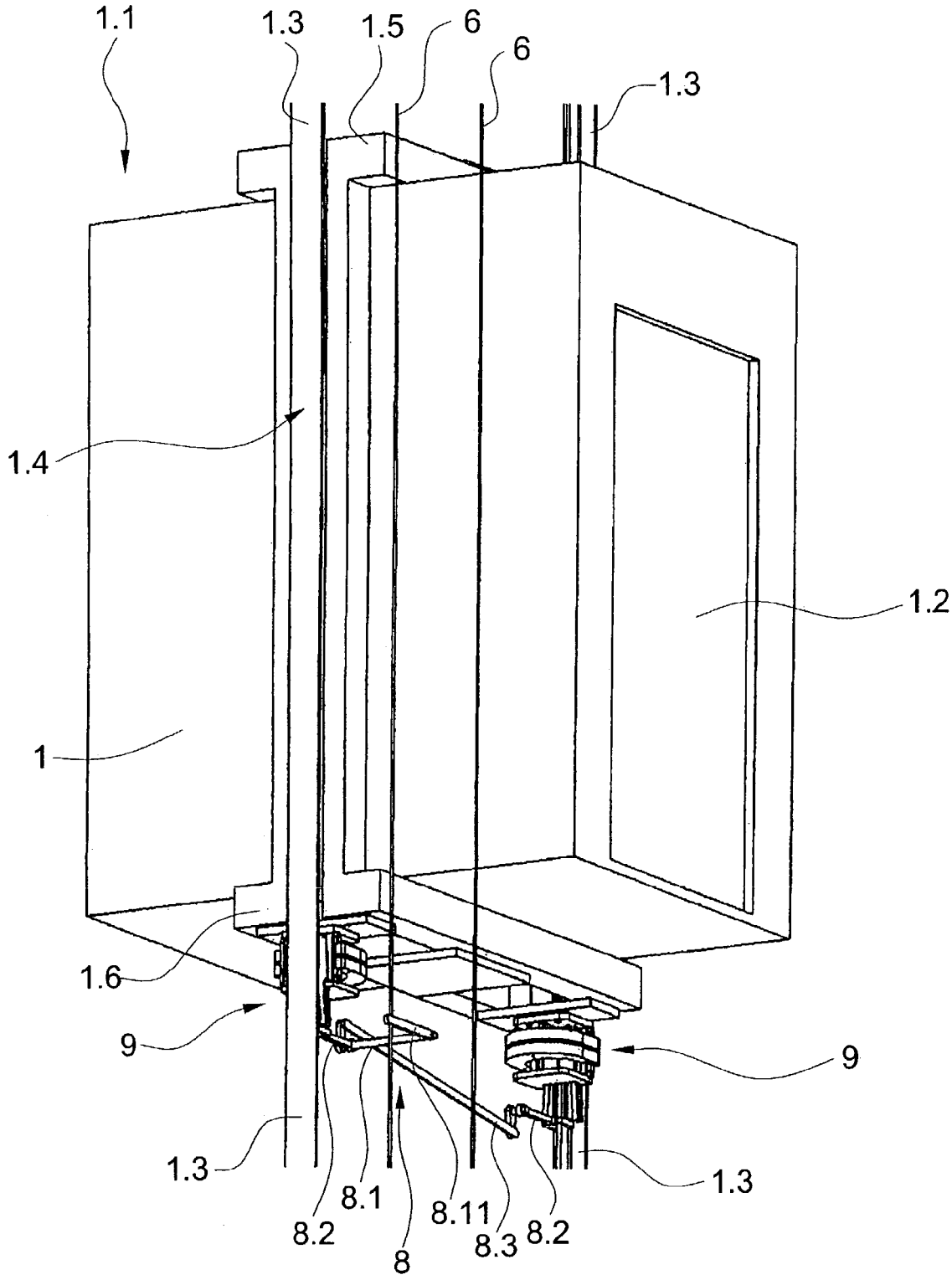
FIG. 3 is a perspective view showing the details of a release mechanism for engaging a safety gear operable by means of a governor rope.

FIG. 3 shows details of the release mechanism 8 for activating the safety gear 9; and the release mechanism is operable by means of the governor rope 6.

The elevator car 1 is carried by a supporting frame 1.4 with a lower hitch 1.6 and an upper hitch 1.5, whereby the carrying rope, led across the (not shown) driving disk, is connected at a first end to the upper hitch 1.5 and at the other end to the (not shown) counterweight. At the lower hitch 1.6 is arranged a safety gear 9 for each safety rail 1.3, and such safety gear stops the elevator car 1 in an emergency. The elevator car 1 moves the pulley 17 of the overspeed governor 5 by means of the governor rope 6, and such overspeed governor 5 releases and activates the rope brake 15 and blocks itself at a certain overspeed of the elevator car 1 in the downward direction. The rope brake 15 and the blocked overspeed governor 5 also block the governor rope 6 led over the deflection sheave arranged in the shaft pit. The elevator car 1, however, moves further downwards, whereby the blocked governor rope 6 connected to the release mechanism 8 engages the safety gear 9.

The release mechanism 8, standing in connection with the governor rope 6, consists of a rotational axle 8.1 with release lever 8.11. An operating fork 8.2 indenting the safety gear 9 is arranged on the axle. The operating fork 8.2 of the opposite lying safety gear 9 is operated by means of a connecting rod 8.3 also arranged on the rotational axle 8.1. With a blocked governor rope 6, the rotational axle 8.1 (viewed from the car door 1.2) is turned in the clockwise direction. At the same time, the free end operating fork 8.2 is lifted and the safety gear 9 engaged.

Figure 4:
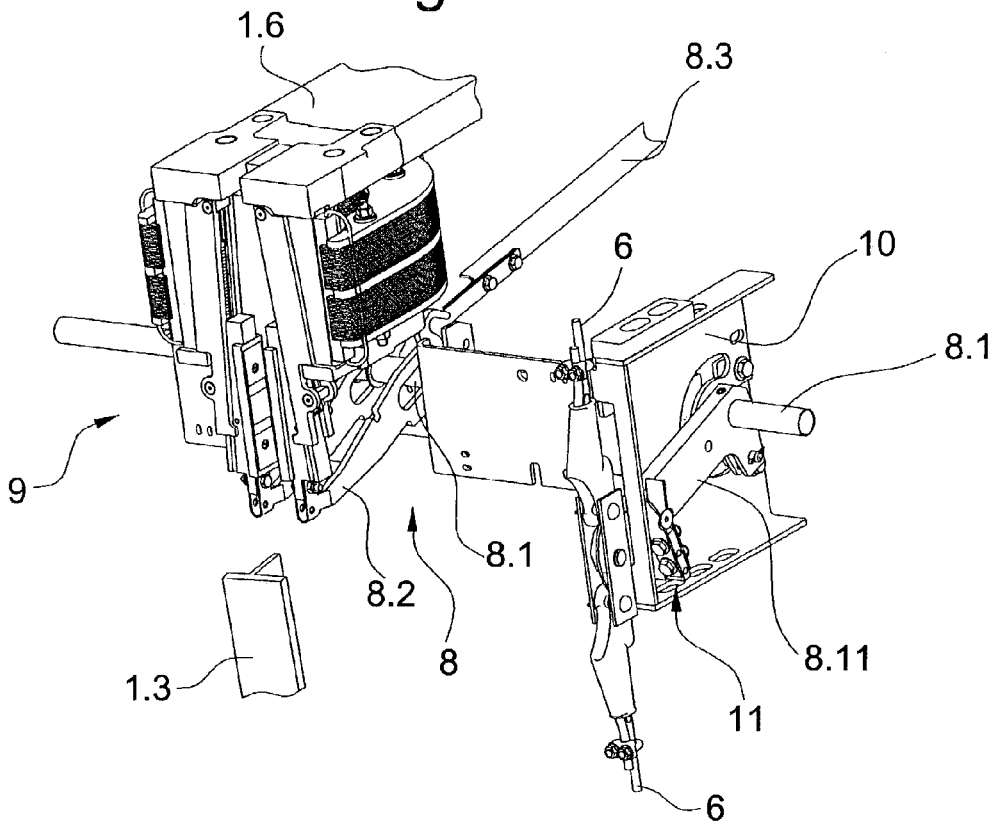
FIG. 4 is a perspective view showing further details of the release mechanism.

FIG. 4 shows details of the release mechanism 8, by which the rotational axle 8.1 is fixed in a housing 10 in a rotational manner. The release lever, 8.11, arranged on the rotational axle 8.1, is connected to governor rope 6 and with a retaining spring 11, which increases the releasing force needed as applied by the governor rope 6. The retaining spring 11 prevents unwanted releases of the safety gear 9 in normal operation. The elevator car 1 is stopped only in an emergency.

Figure 5:
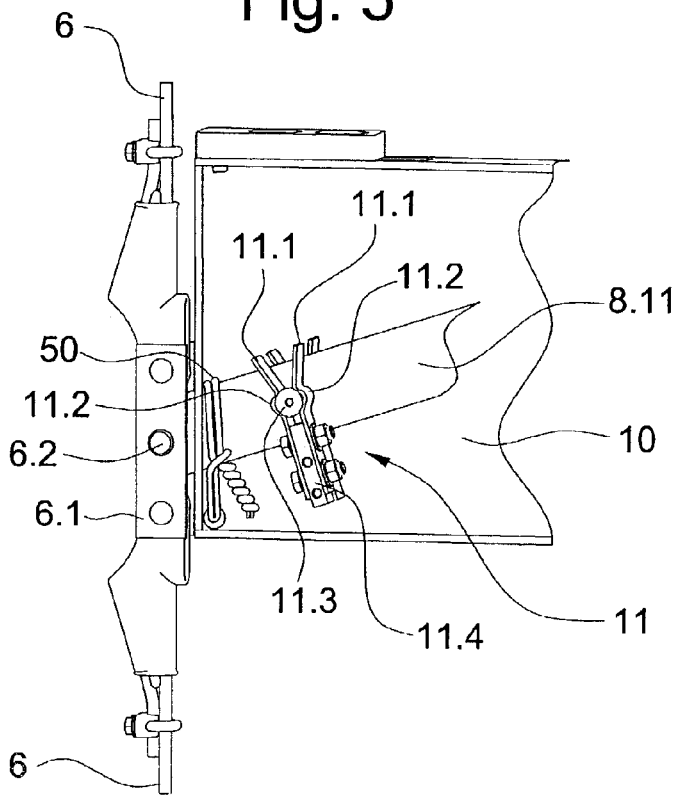
FIG. 5 is a perspective view of details of a locking element for the production of a retaining force.

FIG. 5 shows details of the retaining spring 11 and of a locking element 50 for the production of a release force. The retaining spring 11 consists of two spring halves 11.1, whereby each half of 11.1 has a cam surface portion 11.2. The cams 11.2 are mutually engaged with a pin 11.3 arranged on the release lever 8.11. The spring halves 11.1 are arranged on a base 11.4 connected to the housing 10. The end of the release lever 8.11 is connected in a rotational manner to an axle 6.2 through rope fixing element 6.1 of the governor rope 6. The locking element 50, consists in the present example of a wirewrap 50, between the housing 10 and the release lever 8.11. Other locking elements 50, for example a catcher or an element with a predetermined breaking point, are also possible, whereby the catcher and the predetermined breaking point are dimensioned and constructed as appropriate for the hoisting height. Similarly, the number of wires in the wirewrap depends on the hoisting height. The greater the hoisting height, the more wires the wirewrap has. The release lever 8.11 is fastened to the housing 10 by means of the wirewrap. In an emergency, the overspeed governor 5, together with the rope brake 15 blocks the governor rope 6, whereby the relative motion of release lever 8.11 with respect to the housing 10 breaks the wirewrap 50 and engages the safety gear 9. The force for breaking the wirewrap 50 is generated by the auxiliary block 34.2, by the compression spring 33.2 and by the counter-block 35 and transferred on the governor rope 6. The force for overcoming the retaining spring 11 is similarly produced in an emergency by the brake block 34 and by the counter-block 35 and transferred through the governor rope 6.

In pilot tests and/or with buffer tests at high elevator installations, the release mechanism 8 for the safety gear 9 of the elevator car 1 and/or the counterweight must be fastened in such a way that the safety gear 9 cannot be engaged by the force of inertia of the governor rope 6. However, the fastening of the release mechanism 8 may not have as a consequence that the safety gear 9 can no longer be actuated via the overspeed governor 5 in an emergency. Starting from a certain height of the elevator installation, the necessary force for the establishment of the release mechanism 8 is greater than the release force of the overspeed governor 5. In this case, an auxiliary rope brake is necessary, which provides the force for the release of the established release mechanism 8. The installation, according to the invention, can also be applied to a safety gear of the counterweight.

We claim:

1. A mechanism for engaging a safety gear for an elevator car or counterweight of an elevator in which the elevator includes an overspeed governor supervising the speed of the elevator car which is connected by means of a hoist rope with the counterweight, and in which motion of the elevator car or counterweight is transferred to the overspeed governor by means of a governor rope, the overspeed governor triggering the stopping of the elevator by engagement of the safety gear in an overspeed condition, the mechanism comprising: a release mechanism including a retaining spring connected to a release lever for applying a retaining force of a particular magnitude thereto for retaining the release mechanism in an unreleased position until a release force of a magnitude sufficient to overcome the particular magnitude force is applied to the release lever and a removable locking element connected to the release lever for applying a retaining force of a magnitude greater than the particular magnitude for retaining the release mechanism in an unreleased position, and a rope brake acting on the governor rope to provide a force to activate the the release mechanism in an overspeed condition whereby the retaining spring prevents release of the safety gear during normal operation until the overspeed condition is reached and the locking element when connected to the release lever retains the release mechanism in an unreleased condition during conditions when a greater release force magnitude is desired.

2. The mechanism in accordance with claim 1, wherein the magnitude of the retaining force applied by the locking element is based upon the hoisting height of the elevator.

3. The mechanism in accordance with claim 1 or 2, wherein the locking element is a wirewrap connecting the release mechanism with a housing.

4. The mechanism in accordance with claim 1 or 2, wherein the mechanism includes an auxiliary rope brake acting on the governor rope to provide an additional force to activate the release mechanism.

5. The mechanism in accordance with claim 4, wherein the auxiliary rope brake includes at least one auxiliary block and at least one compression spring coupled to the auxiliary block.

* * * * *